US009706798B2

(12) United States Patent
Walker

(10) Patent No.: US 9,706,798 B2
(45) Date of Patent: Jul. 18, 2017

(54) DRESS ENSEMBLE THAT APPEARS AS A SEPARATE SHIRT AND A SEPARATE SKIRT ENSEMBLE WHEN WORN

(71) Applicant: Mariangela C. Walker, Chapel Hill, NC (US)

(72) Inventor: Mariangela C. Walker, Chapel Hill, NC (US)

( * ) Notice: Subject to any disclaimer, the term of this patent is extended or adjusted under 35 U.S.C. 154(b) by 390 days.

(21) Appl. No.: 14/320,392

(22) Filed: Jun. 30, 2014

(65) Prior Publication Data

US 2014/0310849 A1 Oct. 23, 2014

Related U.S. Application Data

(63) Continuation-in-part of application No. 29/494,974, filed on Jun. 25, 2014, now Pat. No. Des. 774,281, which is a continuation-in-part of application No. 29/374,679, filed on Sep. 21, 2011, now abandoned.

(51) Int. Cl.
*A41D 1/00* (2006.01)
*A41D 1/22* (2006.01)

(52) U.S. Cl.
CPC ..... *A41D 1/22* (2013.01)

(58) Field of Classification Search
CPC ..... A41D 1/22
USPC ..... 2/70, 71, 74, 105; 112/475.09
See application file for complete search history.

(56) References Cited

U.S. PATENT DOCUMENTS

| | | | | |
|---|---|---|---|---|
| 1,287,859 A | | 12/1918 | Bright | |
| 1,646,555 A | | 10/1927 | Page | |
| 1,894,062 A | | 1/1933 | Schrank | |
| 2,091,084 A | | 8/1937 | Quinn | |
| 2,109,867 A | | 3/1938 | Pedlar | |
| 2,142,479 A | | 1/1939 | Rosenfelder | |
| 2,181,517 A | | 11/1939 | London | |
| 2,242,365 A | | 5/1941 | Muhr | |
| 2,274,382 A | * | 2/1942 | Richman | 2/70 |
| 2,283,642 A | * | 5/1942 | Murray | 2/74 |
| 2,327,881 A | * | 8/1943 | Friedman | 2/74 |
| 2,331,626 A | * | 10/1943 | Perlitch | 2/74 |
| 2,433,154 A | | 12/1947 | Pelton | |
| 2,493,545 A | | 1/1950 | Muyleart | |
| 2,515,082 A | | 7/1950 | Evans | |
| 2,559,953 A | * | 7/1951 | Evans | 2/70 |

(Continued)

FOREIGN PATENT DOCUMENTS

CN 103070499 5/2013

OTHER PUBLICATIONS dress, [online], (site visited Jun. 30, 2014). Available from internet. <http://milestogo.squarespace.com/blog/2012/7/2/long-term-goals-short-term-motivators.html>, 1 pg.

(Continued)

*Primary Examiner* — Khaled Annis

(74) *Attorney, Agent, or Firm* — Buche & Associates, P.C.; John K. Buche; Bryce A. Johnson

(57) ABSTRACT

The object of the disclosed subject matter is to provide a way for one to wear a single dress garment while appearing to wear two separate clothing articles, such as an iconographic tee shirt and a separate bottom skirt ensemble. The wearer of the dress garment thus enjoys the aesthetic pleasures of wearing a skirt while enjoying the functional benefits and built-in comforts of a tee shirt and a dress.

10 Claims, 5 Drawing Sheets

(56) References Cited

U.S. PATENT DOCUMENTS

| | | | | | |
|---|---|---|---|---|---|
| 2,562,234 | A | | 7/1951 | Gottschalk | |
| 2,598,759 | A | | 6/1952 | Calde | |
| D168,960 | S | | 3/1953 | Maisch | |
| 2,632,892 | A | | 3/1953 | Wiesenfeld | |
| 2,722,686 | A | | 11/1953 | Hoskings | |
| 2,835,897 | A | * | 5/1958 | Scruggs | 2/71 |
| 3,064,265 | A | * | 11/1962 | Bridgewaters | 2/74 |
| D202,165 | S | | 9/1965 | Hager | |
| 3,217,713 | A | * | 11/1965 | Kunel | 450/30 |
| 3,307,200 | A | | 3/1967 | Erteszek | |
| 3,448,460 | A | * | 6/1969 | Frank | 2/74 |
| 3,609,766 | A | | 10/1971 | Olive | |
| 3,665,516 | A | * | 5/1972 | Orovan | 2/74 |
| 3,961,376 | A | * | 6/1976 | Howell | 2/71 |
| D305,575 | S | | 1/1990 | Gordon et al. | |
| 5,146,626 | A | | 9/1992 | Rosado | |
| 5,173,965 | A | * | 12/1992 | Panner | 2/105 |
| 5,802,612 | A | | 9/1998 | Hosking | |
| 5,806,094 | A | * | 9/1998 | Kasun et al. | 2/69 |
| D402,439 | S | | 12/1998 | Marks | |
| 5,878,437 | A | | 3/1999 | Oater | |
| 6,108,815 | A | | 8/2000 | Majerfeld | |
| D454,245 | S | | 3/2002 | Logan | |
| 6,363,538 | B1 | * | 4/2002 | Davis | 2/247 |
| 6,430,748 | B1 | * | 8/2002 | Burkhart | 2/78.1 |
| D505,768 | S | | 6/2005 | Dallas et al. | |
| D632,050 | S | | 2/2011 | Zarabi | |
| 8,185,970 | B2 | * | 5/2012 | Summers et al. | 2/69 |
| D668,431 | S | | 10/2012 | MacGillivray | |
| D690,905 | S | | 10/2013 | Eutsey et al. | |
| 8,568,195 | B1 | | 10/2013 | Schindler | |
| 8,656,515 | B2 | | 2/2014 | Newton et al. | |
| 2005/0160957 | A1 | * | 7/2005 | Krasnitz | 112/475.18 |
| 2008/0189830 | A1 | * | 8/2008 | Egglesfield | 2/244 |
| 2008/0244805 | A1 | * | 10/2008 | Griffin | 2/74 |
| 2009/0158489 | A1 | * | 6/2009 | White et al. | 2/69 |
| 2009/0222970 | A1 | * | 9/2009 | Coleman | 2/108 |
| 2009/0260123 | A1 | * | 10/2009 | Swift | 2/69 |
| 2013/0212779 | A1 | * | 8/2013 | Dowling et al. | 2/243.1 |
| 2015/0089708 | A1 | * | 4/2015 | Trevino | 2/69 |

OTHER PUBLICATIONS

Simple Dress, (Jul. 7, 2008), (site visited Jun. 30, 2014). Avalable Internet <http://mariemadellnestudio.typepad.com/mariemadeline_studio/2008/07/dressmaking-fun.html>, 3 pg.

Two Tone T-shirt Dress, (Mar. 8, 2010), (site visited Jun. 30, 2014). Available Internet <http://heartymagazine.com/features/diy-double-trouble-two-tone-t-shirt-dress>, 4 pg.

ASOS T-shirt Dress with Drop Waist, (site visited March Jun. 30, 2014), <http://www.asos.com/ASOS/ASOS-T-Shirt-With-Drop-Waist/Prod/pgeproduct.aspx?iid=2934500&r=2>.

* cited by examiner

DRESS ENSEMBLE THAT APPEARS AS A SEPARATE SHIRT AND A SEPARATE SKIRT ENSEMBLE WHEN WORN

CROSS-REFERENCE TO RELATED APPLICATIONS

This application is a continuation in part of design application Ser. No. 29/494,974 filed on Jun. 25, 2014, entitled "DESIGN FOR A DRESS GARMENT" and continuation in part to Ser. No. 29/374,679 filed on Sep. 21, 2011, entitled "THE T-SKIRT DRESS." This document is incorporated by reference in its entirety.

STATEMENT REGARDING FEDERALLY SPONSORED RESEARCH OR DEVELOPMENT

Not applicable.

FIELD OF INVENTION

The subject matter disclosed is within the field of clothing articles. In particular, the disclosed subject matter relates to dress attire. The disclosed subject matter may also be in the field of bathing suit covers, sleepwear, and recreational attire.

BACKGROUND OF THE INVENTION

The fashion industry is a multi-billion dollar industry that caters to various audiences with different fashion tastes, preferences, and needs. People often decide to dress a particular way or style depending on the type of setting, environment and social function. As people live more varied lifestyles, people have the increasingly diverse need to have different clothing styles to match their busy lifestyle. Furthermore, clothes such as tee shirts have become a fashionable platform where people can express themselves about their beliefs, affiliations, or particular sentimental values. In particular, iconographic tee shirts have flourished as a form of personal expression because of a decorative image or message that is placed at the front and/or back sides of the iconographic tee shirt. As a result, iconographic tee shirts are often the prime choice for not only comfortable lounge wear, but also as a way of expressing the wearer's ideologies, beliefs, and adoration for a particular subject matter. Thus, an iconographic tee shirt has flourished into a prominent form of public speech that allows consumers to express not only their fashion tastes, but also their social and cultural tastes.

Currently, dresses and skirts are available to consumers with a wide range of styles and designs. Both dress and skirts can be worn to upscale fanciful events or to casual gatherings depending on the style and material of the dress or skirt.

While choosing between a dress and skirt is often a personal stylistic choice, a dress is often more comfortable and convenient to wear because it is a one piece garment article that does not restrict or pinch the waistline. Also, a dress will not expose the wearer's bare midriff or personal undergarment since a dress is one long continuous garment. However when a skirt is worn, a shirt may often become untucked and expose the wearer's midriff or undergarments, often leading to uncomfortable and embarrassing situations for the wearer. Furthermore, with a dress, the wearer does not need to take the extra time to decide which bottom pant or skirt ensemble will best stylistically match the wearer's top shirt ensemble. As a result, a casual dress is often the optimal choice for comfort, functionality and efficiency.

Although many people understand that a dress may be more comfortable and practical to wear, some people still stylistically prefer to wear a skirt and many often even prefer wearing a tee shirt because a tee shirt is often a staple in the wardrobe and comfortable to wear on any casual occasion.

In view of the foregoing, a need exists which allows the wearer to enjoy the aesthetic pleasures of a skirt while appreciating the functional benefits and built-in comforts of a dress and a tee shirt. The subject matter disclosed provides the particular need since the disclosed subject matter is a dress garment, but appears to others as if the wearer is actually wearing two different articles of clothing, such as a tee shirt and a matching skirt ensemble. Thus, the wearer appears as if wearing a skirt but is actually wearing a dress, or one long garment made from fabrics typically used to make tee shirts, such as cotton, polyester, knit fabric or any combinations thereof.

SUMMARY OF THE INVENTION

The present subject matter disclosed provides a simple and elegant way for one to wear a single dress garment while appearing to wear two completely different clothing articles, such as a separate tee shirt and a separate bottom skirt ensemble. Thus the wearer enjoys the aesthetic pleasures of a skirt while appreciating the functional benefits and built-in comforts of a dress and a tee shirt.

In one embodiment, the dress garment is an iconographic tee shirt and bottom skirt ensemble combination to give the appearance that the wearer is wearing two separate articles of clothing despite the dress garment being constructed as a one piece garment.

Other objectives and desire may become apparent to one of skill in the art after reading the below disclosure and viewing the associated figures. Also, these and other embodiments will become apparent in the drawings.

Terms and phrases used in this document, and variations thereof, unless otherwise expressly stated, should be construed as open-ended as opposed to limiting. As examples of the foregoing: the term "including" should be read as meaning "Including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

In the figures the following numerals are associated with their corresponding components as follows:

(1000) Dress garment ensemble
(1100) Iconographic tee shirt ensemble;
(1110) Sleeves of iconographic tee shirt ensemble
(1120) Neckline of iconographic tee shirt ensemble
(1200) Bottom skirt ensemble
(1300) Serge stitch

DETAILED DESCRIPTION OF PREFERRED EMBODIMENTS

In general, disclosed is an improved dress garment with the appearance of two completely different clothing articles, such as a separate iconographic tee shirt and a separate bottom skirt ensemble. In one embodiment, the dress garment is an iconographic tee shirt and bottom skirt combination stitched together (e.g., single serge stitch), giving the appearance that the wearer is wearing two separate articles of clothing despite the dress garment being constructed as a one piece garment. The specific details concerning the dress garment are disclosed with reference to the attached figures.

Figure 1:
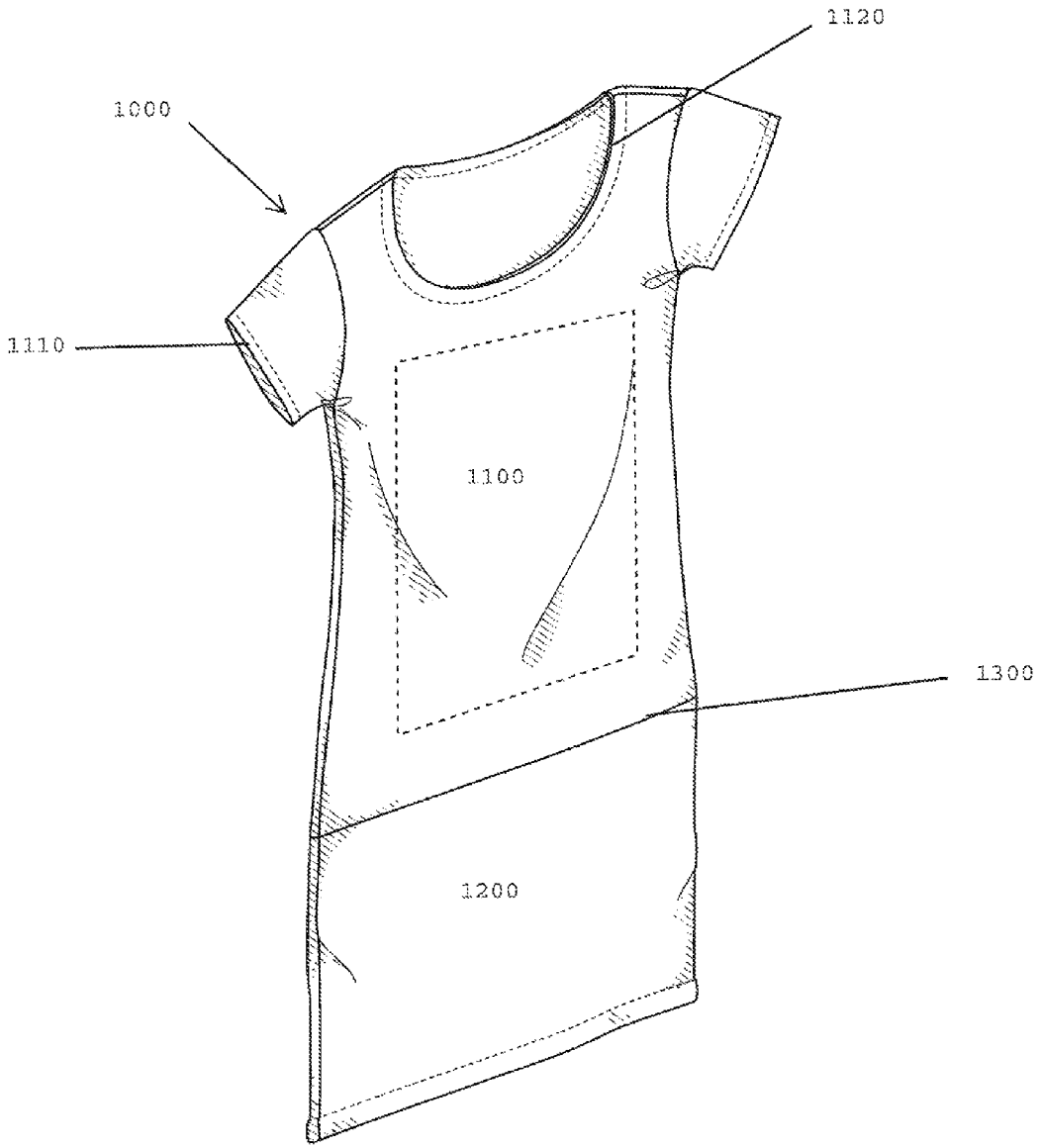
FIG. 1 is a perspective view of a garment that appears as a separate tee shirt and skirt.

FIGS. 1 through 5 respectively illustrate a front view, back view, left view, right view, top view, and bottom view of a preferred dress garment 1000. More specifically, FIG. 1 depicts a perspective view of the preferable embodiment of a dress garment 1000 which preferably comprises: an iconographic tee shirt ensemble 1100 comprising a neckline 1120 and sleeves 1110, a single serge stitch 1300 and a bottom skirt ensemble 1200 to create a one piece dress garment 1000. Also, the tee shirt graphic on the iconographic tee shirt ensemble 1100 is depicted in FIG. 1 as a broken line rectangle. However it should be noted that the broken line rectangle depicting the graphic on the tee shirt ensemble 1100 is not an indication that the graphic must be a rectangle or a particular size, but rather is a general indicator that a graphic is placed on the front part of the tee shirt ensemble 1100.

Figure 2:
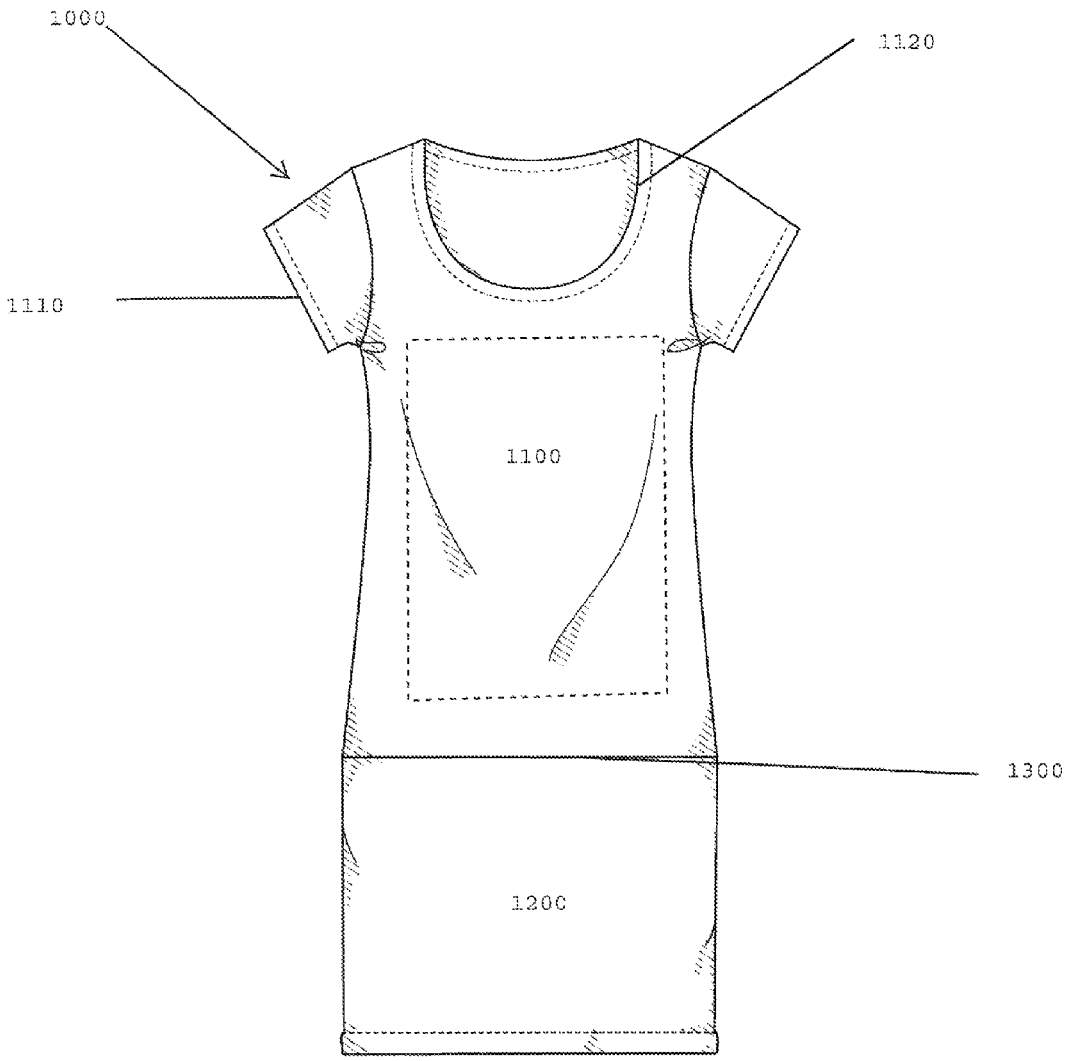
FIG. 2 is a front view of the dress garment of FIG. 1.

FIGS. 2 through 7 depict the six orthogonal views of the dress garment 1000 of FIG. 1. In one embodiment, the iconographic tee shirt ensemble 1100 consists of sleeves 1110 with varied lengths to suit the stylistic preference of the wearer. As best seen in FIG. 2, the sleeves 1110 are attached to the iconographic tee shirt ensemble 1100. It should be noted that the sleeve lengths may vary. For example, the sleeve lengths may be cap, short, elbow, bracelet, long, or ¾ length. While in other embodiments, the iconographic tee shirt ensemble 1100 may be sleeveless (not shown).

In other embodiments, the iconographic tee shirt ensemble 1100 is preferably made of cotton, cotton polyester blend, knit fabric or any combinations thereof. One having skill in the art will appreciate that the varied fabric materials for the iconographic tee shirt ensemble 1100, considering such issues as stylistic preference, wearer preference, manufacturing preference, cost, structural requirements, available materials, etc., may suffice for the iconographic tee shirt ensemble 1100.

Figure 8:
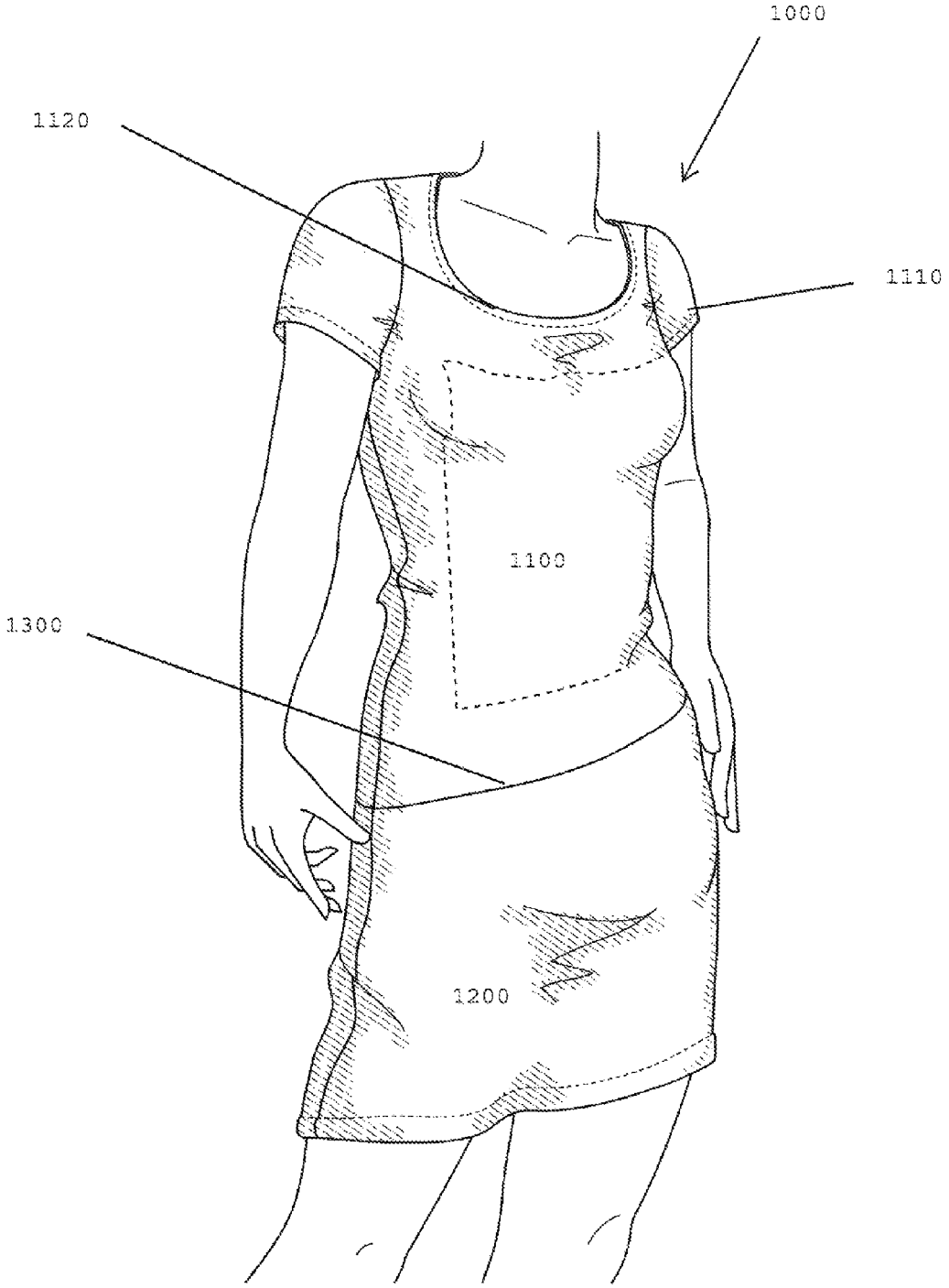
FIG. 8 is an environmental view of a wearer wearing the garment of FIG. 1.

In some embodiments, the neckline 1120 of the iconographic tee shirt ensemble 1100 may be of varied different styles to suit the stylistic preference of the wearer. As best seen in FIG. 8, the neckline 1120 is the top edge of the dress garment 1000 that surrounds the neck. It should be noted that various neckline styles may be used for the dress garment 1000. For example, the neckline 1120 may be a plunging, v-shaped, square, bateau, draped, round, lunging, one-shoulder, scoop, halter, ballet neckline and the like. One having skill in the art will appreciate that the varied styles for the neckline, considering such issues as stylistic preference, wearer preference, manufacturing preference, cost, structural requirements, available materials, etc., may suffice for other neckline styles.

In further embodiments, the iconographic tee shirt ensemble 1100 may have decorative elements to accentuate the appearance that the wearer is wearing an iconographic tee shirt 1100 and to appease the fashionable preferences of the wearer (not shown). For example, the decorative elements to the iconographic tee shirt ensemble 1100 may consist of lace, bead adornments, bows, ruffles, cut outs, frills and the like. One having skill in the art will appreciate that the varied decorative elements for the iconographic tee shirt ensemble 1100, considering such issues as stylistic preference, wearer preference, manufacturing preference, cost, structural requirements, available materials, etc., so that other decorative elements may suffice.

Figure 5:
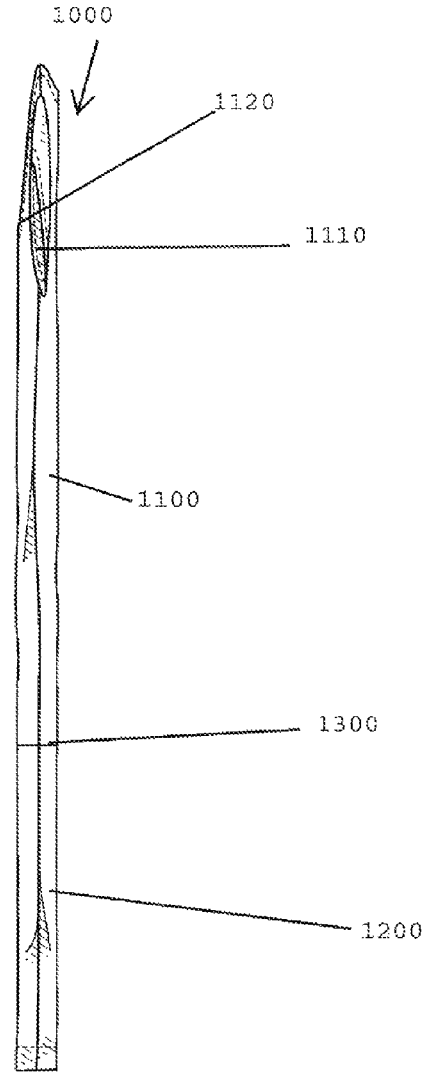
FIG. 5 is a right view of the dress garment of FIG. 1.
Figure 6:
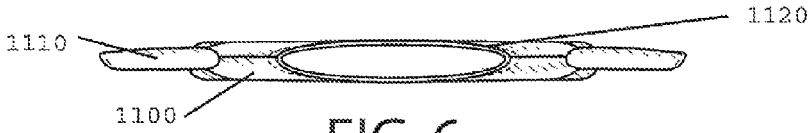
FIG. 6 is the top view of the dress garment of FIG. 1.
Figure 7:
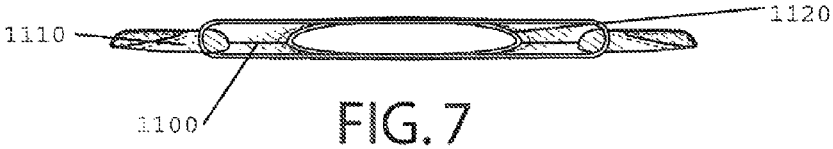
FIG. 7 is the bottom view of the dress garment of FIG. 1.

In other embodiments, the bottom skirt ensemble 1200 may be varied lengths depending on stylistic preference of the wearer. As seen in FIG. 5, the bottom skirt ensemble 1200 may be constructed to fall above the knee. It should be noted that various lengths for the bottom skirt ensemble 1200 are available. For example, the bottom skirt ensemble 1200 may be floor, ankle, tea, knee, or above knee length.

In other embodiments, the bottom skirt ensemble 1200 is constructed of a different fabric material from the iconographic tee shirt ensemble 1100 in order to further accentuate and highlight the appearance that the wearer is wearing two separate clothing articles. The bottom skirt ensemble 1200 is made of various fabric materials such as cotton, cotton-polyester blends, knit fabric or any combinations thereof. One having skill in the art will appreciate that the varied fabric materials for the bottom skirt ensemble 1200, considering such issues as stylistic preference, wearer preference, manufacturing preference, cost, structural requirements, available materials, etc., so that other bottom skirt fabric materials may suffice.

In the preferred embodiment, the iconographic tee shirt ensemble 1100 and the bottom skirt ensemble 1200 are different colors in order to further accentuate and highlight the appearance that the wearer is wearing two separate clothing articles.

In further embodiments, the bottom skirt ensemble 1200 may have at least two belt loops encompassing the single serge stitch 1300 of the bottom skirt ensemble 1200 so that a belt may be securely worn with the dress garment 1000.

In further embodiments, the bottom skirt ensemble 1200 may have decorative elements to accentuate the appearance that the wearer is wearing a skirt and to appease the fashionable preferences of the wearer. For example, the decorative elements to the bottom skirt ensemble 1200 may consist of lace, bead adornments, bows, pleats, ruffles, and the like (not shown). One having skill in the art will appreciate that the varied decorative elements for the bottom skirt ensemble 1200, considering such issues as stylistic preference, wearer preference, manufacturing preference, cost, structural requirements, available materials, etc., so that other decorative elements may suffice.

Figure 3:
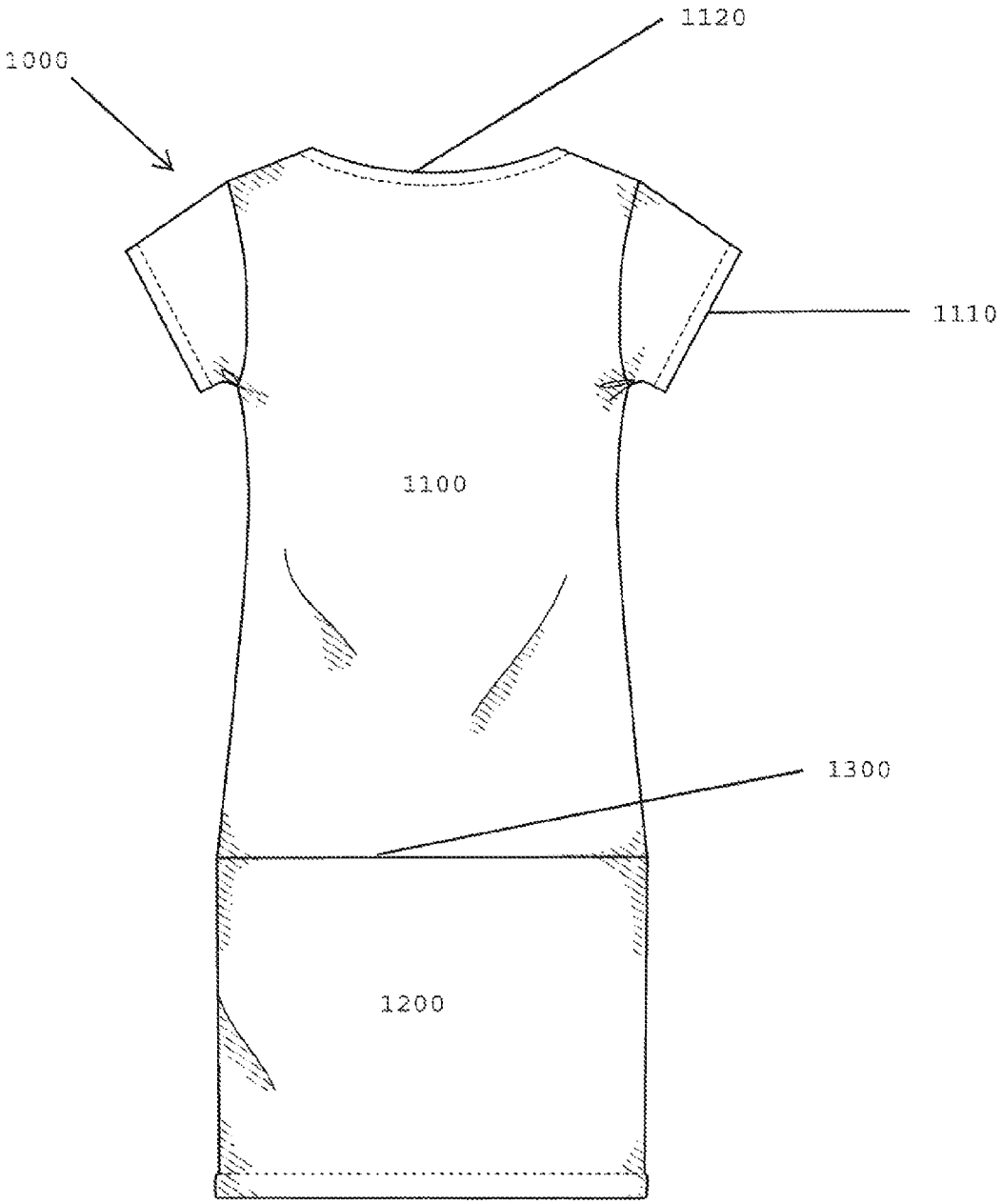
FIG. 3 is a back view of the dress garment of FIG. 1.
Figure 4:
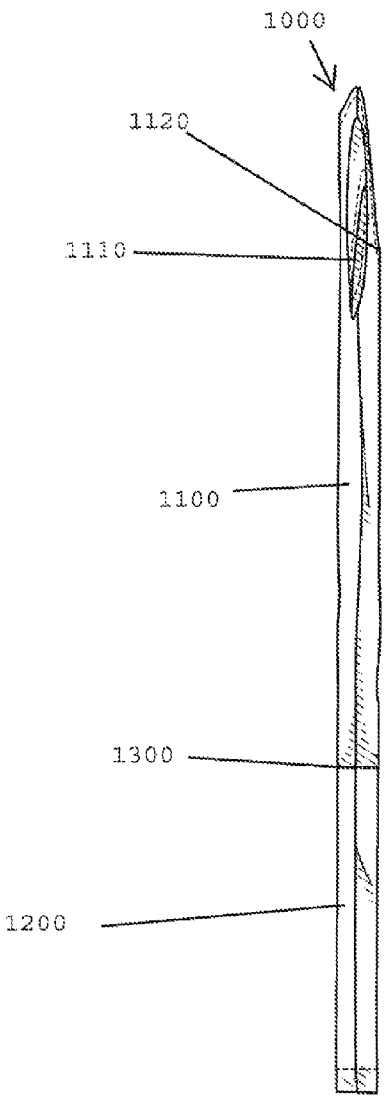
FIG. 4 is left view of the dress garment of FIG. 1.

In other embodiments, a single serge stitch 1300 connects the iconographic tee shirt ensemble 1100 to the bottom skirt ensemble 1200. The serge herb stitch 1300 may be sewn at varied lengths depending on the wearer's stylistic preference. As seen in FIGS. 2-3, the single serge stitch 1300 is visible to further accentuate the appearance of two separate clothing articles, such as an iconographic tee shirt and a bottom skirt ensemble. Furthermore, the single serge stitch may be sewn to fall near the wearer's lower hipbone or as high as the wearer's upper chest or any length in between depending of the wearer's stylistic preference.

EXAMPLE

In one example, a ustomer visits a store that specializes in creating customized dresses that appear as if one is wearing two completely different clothing articles, such as a separate iconographic tee shirt and a separate bottom skirt ensemble. Wishing to create such a customized dress, the customer enters the customizable clothing store. The customer is presented with a wide variety of iconographic tee shirts and bottom skirts of all sizes, colors, styles and designs. The customer proceeds to pick out an iconographic tee shirt and ultimately selects a brown cotton iconographic tee shirt with a graphic print of coffee mug with a round neckline and capped sleeves. After selecting the iconographic tee shirt of her choice she then proceeds to select a bottom skirt that she believes will best match her brown tee shirt and personal style. Wishing to wear her customized garment dress as casual wear for the summer time, she then selects a knee-length yellow bottom skirt to be paired with the brown tee shirt.

The customer hands the brown cotton tee shirt and the separate knee-length yellow cotton bottom skirt to an employee who will proceed to stitch the two articles of clothing into one dress garment. Prior to stitching the two garments together, the employee takes the customer's measurements so that the bottom of the tee shirt and the top of the bottom skirt will be hemmed along the customer's waistline, further giving the appearance that the customer is wearing a tee shirt and a bottom skirt instead of one dress garment.

The employee then takes the brown tee shirt and yellow bottom skirt to a work station and sews the bottom of the brown tee shirt and the top of the yellow bottom skirt together with a serge hem stitch to create a dress garment. In a preferred method, the employee, keeping the tee shirt right side out, and the skirt fabric right side out, lines the skirt and tee-shirt up together on a work table. Next, the employee reveals the inside fabric at the bottom of the tee shirt (maybe ¼ or ½ inch) and this is brought together (not overlapped, but joined) with the same length of inside fabric of the top portion of the skirt. The garment is then sewn with serge stitch so that the t-shirt and skirt are joined. Suitably, this method will create an outside seam for the garment. However, the seam joining the top to bottom can be placed on the inside of dress as well.

One having skill in the art will appreciate that the various modifications and variation that can be made in the present invention without departing from the scope of the invention. Thus, it is intended the present invention cover the modifications and variations of this invention provided they come within the scope of the appended claims and equivalents.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical er physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in, which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Additionally, the various embodiments set forth herein are described in terms of exemplary illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

I claim:

1. A method of creating a dress garment, comprising:

selecting an iconographic tee shirt ensemble in a right-side-out configuration, said iconographic tee shirt ensemble having a neckline around a neck opening at a top portion of the iconographic tee shirt ensemble and a lower hem around a body opening of the iconographic tee shirt ensemble at a bottom portion of the iconographic tee shirt ensemble;

selecting a bottom skirt ensemble in a right-side-out configuration, said bottom skirt ensemble featuring a waistline hem around a top portion of the bottom skirt ensemble;

lining up the bottom portion of the iconographic tee shirt ensemble and the top portion of the bottom skirt ensemble on a work table or other surface;

revealing a ¼ to ½ inch long inside-out portion of the iconographic tee-shirt ensemble along the lower hem of the iconographic tee shirt ensemble;

bringing together the inside-out portion of the iconographic tee shirt ensemble with an inside-out portion of the bottom skirt ensemble along the waistline of the bottom skirt ensemble, where the inside-out portion of the bottom skirt ensemble is equal in length to the inside out portion of the iconographic tee shirt ensemble; and, joining the iconographic tee shirt ensemble and the bottom skirt ensemble together with a serge hem stitch to create a dress garment with an outside seam along the lower hem of the iconographic tee shirt ensemble and along the waistline hem of the bottom skirt ensemble so that the outside seam is visible to give the appearance of wearing two different clothing articles.

2. The method of creating a dress garment of claim 1 wherein selecting a tee shirt ensemble created from materials selected from the group consisting of cotton, polyester, knit fabric or combinations thereof.

3. The method of creating a dress garment of claim 1 wherein selecting a bottom skirt ensemble created from materials selected from the group consisting of cotton, polyester, knit fabric or combinations thereof.

4. The method of creating a dress garment of claim 1 wherein selecting a tee shirt ensemble comprising a neckline selected from the group consisting of plunging, v-shaped, square, bateau, draped, round, lunging, one-shoulder scoop, halter, ballet neckline and any combinations thereof.

5. The method of creating a dress garment of claim 1 wherein selecting a tee shirt ensemble comprising varied sleeve lengths selected from the group consisting of cap, short, elbow, bracelet, long, ¾ length or any combinations thereof.

6. The method of creating a dress garment of claim 1 wherein selecting a tee shirt ensemble comprising decorative elements selected from the group consisting of lace, bead adornments, bows, ruffles, cut outs, frills or any combinations thereof.

7. The method of creating a dress garment of claim 1 wherein selecting a tee shirt ensemble with no sleeves.

8. The method of creating a dress garment of claim 1 wherein selecting a top bottom skirt ensemble comprising varying skirt lengths selected from the group consisting of floor, ankle, tea, knee, above knee length or any combinations thereof.

9. The method of creating a dress garment of claim 1 wherein selecting a bottom skirt comprising at least 2 belt loops around the waistline of the bottom skirt ensemble.

10. The method of creating a dress garment of claim 1 wherein selecting a bottom skirt comprising decorative elements selected from the group consisting of bows, pleats, ruffles or any combinations thereof.

* * * * *